US008534879B2

(12) United States Patent
Chang

(10) Patent No.: US 8,534,879 B2
(45) Date of Patent: Sep. 17, 2013

(54) LED UNIT

(75) Inventor: Hsiu-Ping Chang, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 218 days.

(21) Appl. No.: 13/278,112

(22) Filed: Oct. 20, 2011

(65) Prior Publication Data

US 2012/0106167 A1 May 3, 2012

(30) Foreign Application Priority Data

Nov. 3, 2010 (TW) ..... 99137738 A

(51) Int. Cl.
*F21V 3/04* (2006.01)
*F21V 3/02* (2006.01)

(52) U.S. Cl.
USPC ..... 362/311.02; 362/311.06

(58) Field of Classification Search
USPC ..... 362/311.01–311.15, 351–361, 473–476, 362/520–522
See application file for complete search history.

(56) References Cited

U.S. PATENT DOCUMENTS

2009/0213608 A1* 8/2009 Mozaffari-Afshar et al. ..... 362/520
2011/0002126 A1* 1/2011 Chen et al. ..... 362/296.01

* cited by examiner

*Primary Examiner* — Karabi Guharay
*Assistant Examiner* — Nathaniel Lee
(74) *Attorney, Agent, or Firm* — Altis & Wispro Law Group, Inc.

(57) ABSTRACT

A lens comprises a base; the base comprising a bottom face having a light incident face adapted to diffuse light into the lens, and a top face; a first member; and a second member, wherein the first and second members extend from the top face and away from the bottom face, wherein the first member comprises a first light emergent face having a convex surface curved outward from the top face, and directs light to areas far away from the lens, and wherein the second member comprises a second light emergent face having a flat surfaced finish and is at a first angle from the top face, and directs light to areas near the lens; and a third light emergent face between the first and the second light emergent faces, wherein the third light emergent face has a rough surface finish, and also directs light to areas near the lens.

20 Claims, 2 Drawing Sheets

LED UNIT

CROSS-REFERENCE TO RELATED APPLICATION

This patent application is related to two patent applications, having respective Ser. Nos. 13/278,109 and 13/277,237, both entitled "LED UNIT", assigned to the same assignee, and disclosures of which are incorporated herein by reference in its entirety.

BACKGROUND

1. Technical Field

The present disclosure relates to LED (light emitting diode) units, and more particularly, to an LED unit having a lens.

2. Description of Related Art

Light emitting diodes ("LEDs") are widely used as new types of light sources in various applications, such as road lamps, traffic lamps, tunnel lamps, resident lamps and so on. A lens is often used with an LED for collimating the light beams generated from the LED in a predetermined pattern. For LED products designed to illuminate areas at a long distance, a convex lens may be used to converge the light beams emitted from the LED. However, in other applications, such as vehicle headlamps, the LED products need to be able to provide illuminations not only to the area far away from the LED, but also the area near the LED. LED products with the conventional convex lens may not meet such requirements.

What is needed, therefore, is an LED unit which may overcome the deficiencies as described above.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
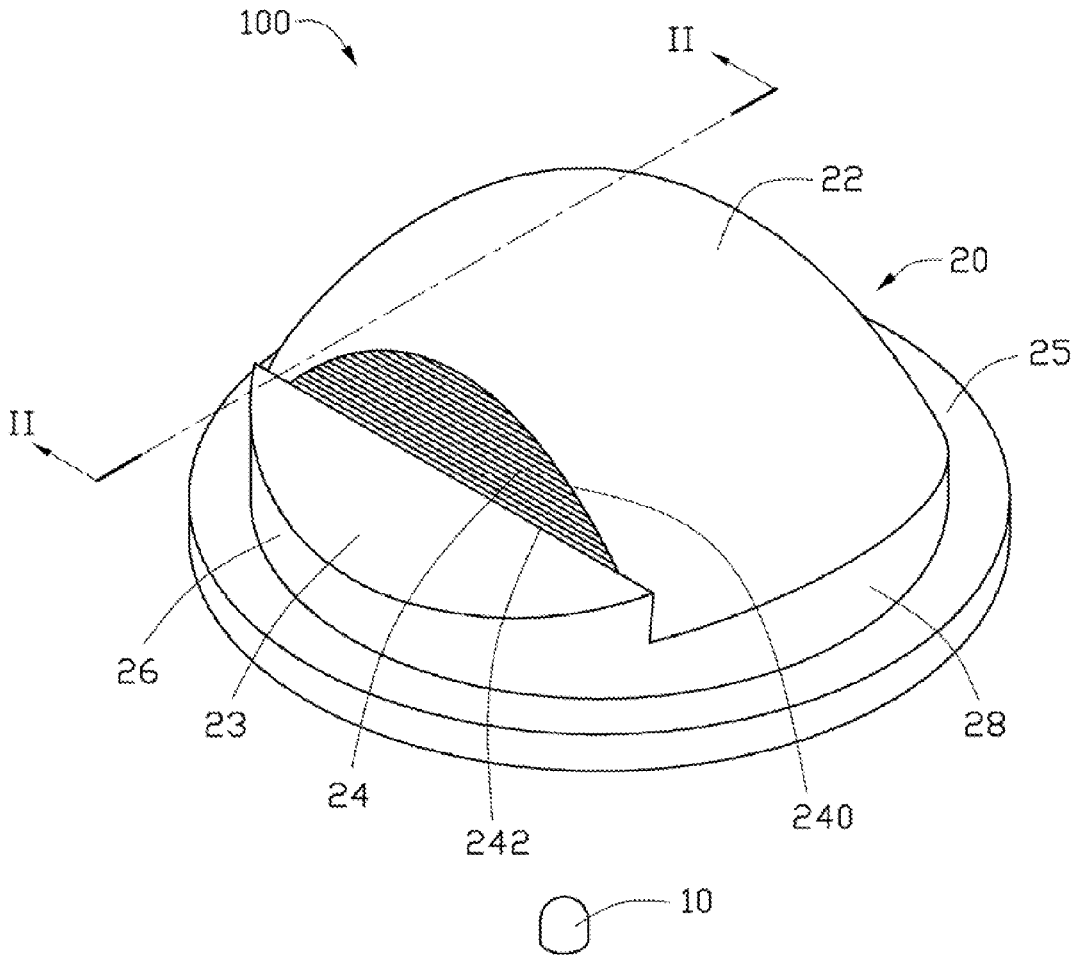
FIG. 1 is an isometric view of an LED unit in accordance with an embodiment of the present disclosure.

Referring to FIG. 1, an LED unit 100 in accordance with an embodiment of the present disclosure is shown. The LED unit 100 may be applied in vehicle headlamps or other suitable products where the areas both near and remote from the LED unit 100 are required to be illuminated. The LED unit 100 includes a lens 20 on the light emitting side of an LED 10.

Figure 2:
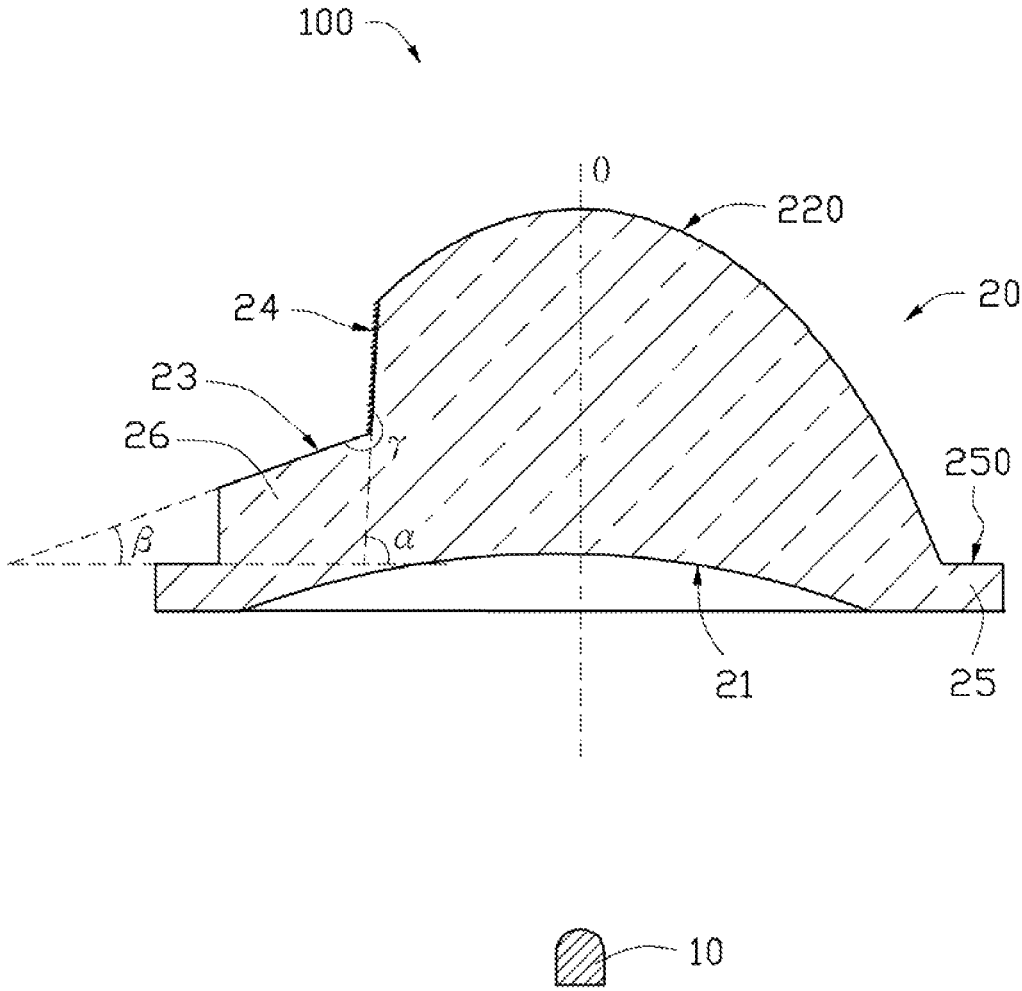
FIG. 2 is a cross sectional view of the LED unit taken along line II-II of FIG. 1.

In one embodiment, the LED 10 generates white light. However, other types of LEDs which generate different light colors, may also be used in the LED unit 100. The lens 20 may be made of a transparent material such as epoxy, silicon, glass and so on. Referring to FIG. 2, the lens 20 may include a base 25, a first member 22 and a second member 26 formed on a top face 250 of the base 25. The base 25 may have a substantially disk shape. A bottom face of the base 25 may function as a light incident face 21 for transmitting light emitted from the LED 10 to the lens 20. In the embodiment of the present disclosure, the light incident face 21 is a concave surface to diffuse light emitted from the LED 10 into the lens 20. A top face 250 of the base 25 may be planar.

The first member 22 is a convex dome curves outward from the top face 250 of the base 25. Circumferences of the first member 22 have diameters gradually decreasing outward from the top face 250 to a top of the convex doom. The first member 22 may converge a part of incident light from the light incident face 21 into narrow light beams to illuminate areas far away from the LED unit 100. Preferably, the first member 22 has an optical axis O perpendicular to the top face 250 of the base 25. The LED 10 may be placed on the axis O and on the concave side of the lens 20 so that the light emitted by the LED 10 may be collimated by the first member 22 to parallel light beams emitted out of the LED unit 100. An outer face of the first member 22 may function as a first light emergent face 220 for transmitting the light out of the lens 20.

The second member 26 is connected with the first member 22. A continuous annular lateral face 28 comprises a sidewall of the second member 26 and a sidewall of the first member 22. The continuous annular lateral face 28 is connected to the top face 250 of the base 25. The continuous annular lateral face 28 has a largest height where the second member 26 and the first member 22 join. The second member 26 has an inclined top face with a flat surface finish. The inclined top face of the second member 26 may function as a second light emergent face 23 to direct light from the LED to illuminate areas near the LED unit 100. The convex doom of the first member 22 is intersected by a third light emergent face 24, which is connected to the second member 26. The third light emergent face 24 is bordered by a curved top edge 240 and a straight bottom edge 242. The third light emergent face 24 is connected to the second light emergent face 23 at the straight bottom edge 242, and connected to the first light emergent face 220 at a curved top edge 240. The third light emergent face 24 has a surface area less than a surface area of the second light emergent face 23, and the surface area of second light emergent face 23 is much smaller than a surface area of the first light emergent face 220. The third light emergent face 24 is at an angle $\alpha$ from the top surface 250 of the base 25, wherein the angle $\alpha$ is equal to or less than 90 degrees. The third light emergent face 24 has a rough surface finish which may be formed by a plurality of parallel saws. The third light emergent face 24, together with the second light emergent face 23, may uniformly diffuse light from the light incident face 21 to provide even better illuminations to areas near the LED unit 100. The second light emergent face 23 is at an angle $\beta$ from the top face 250, wherein the angle $\beta$ is smaller than the angle $\alpha$. An angle $\gamma$ between the second light emergent face 23 and the third light emergent face 24, measured facing the LED 10, is between 180 degrees and 270 degrees.

When the LED unit 100 is applied to a headlamp of a vehicle, light emitted from the first light emergent face 220 may form a high beam to illuminate areas far away from the vehicle; whereas light emitted from the second light emergent face 23 and the third light emergent face 24 may form a low beam to illuminate areas near the vehicle. As a result, areas in front of the vehicle may have a better visibility.

It is believed that the present disclosure and its advantages will be understood from the foregoing description, and it will be apparent that various changes may be made thereto without departing from the spirit and scope of the present disclosure or sacrificing all of its material advantages, the examples hereinbefore described merely being preferred or exemplary embodiments.

What is claimed is:

1. A lens comprising:

a base, the base comprising a bottom face facing a light emitting side of a light source, and a top face, the bottom face has a light incident face adapted to diffuse light into the lens;

a first member and a second member, wherein the first and second members extend from the top face and away from the bottom face of the base, wherein the first member comprises a first light emergent face, the first light emergent face has a convex surface curved outward from the top face, and light emitted from the first light emergent face illuminates areas far away from the lens, and wherein the second member comprises a second light emergent face, the second light emergent face has a flat surface finish, the second light emergent face is at a first angle from the top face, and light emitted from the second light emergent face illuminates first areas near the lens; and a third light emergent face formed between the first light emergent face and the second light emergent face, wherein the third light emergent face has a rough surface finish, the third light emergent face uniformly directs light to illuminate second areas near the lens.

2. The lens of claim 1, wherein the second member has a height less than a height of the first member, measured from the top face.

3. The lens of claim 1, wherein the second member is connected to the first member.

4. The lens of claim 3, wherein the third light emergent face has a curved top edge connected to the first light emergent face, and a straight bottom edge connected to the second light emergent face.

5. The lens of claim 4, wherein a continuous annular lateral face comprises a sidewall of the first member and a sidewall of the second member.

6. The lens of claim 5, wherein the continuous annular lateral face has a largest height measures from the top face to the straight bottom edge.

7. The lens of claim 1, wherein the rough surface finish of the third light emergent face is saw-toothed.

8. The lens of claim 1, wherein the first light emergent has a surface area larger than both a surface area of the second light emergent face and a surface area of the third light emergent face.

9. The lens of claim 1, wherein the second light emergent face is at a first angle from the top face, the third light emergent face is at a second angle from the top face, and the second angle is larger than the first angle.

10. The lens of claim 9, wherein the second light emergent face is at a third angle from the third light emergent face, measured facing the light source, and the third angle is between 180 degrees and 270 degrees.

11. The lens of claim 1, wherein the first member has an optical axis extending through the light incident face.

12. An LED (light emitting diode) unit comprising:

an LED;

a lens comprising a light incident face facing the LED, a second member, and a first member connected to the second member;

wherein the first member comprises a first light emergent face through which light from the LED illuminates areas far away from the lens, the second member comprises a second light emergent face through which light from the LED illuminates first areas near the lens, and the first member has an optical axis extending through the light incident face; and a third light emergent face formed between the first light emergent face and the second light emergent face; wherein the third light emergent face has a rough surface finish, and the third light emergent face directs light from the LED to illuminate second areas near the lens.

13. The LED unit of claim 12, wherein the second light emergent face has a flat surface finish, and the second light emergent face is at a first angle from the optical axis.

14. The LED unit of claim 12, wherein the first light emergent face is convex curved outward from the LED, and the first light emergent face has a surfaced area larger than both a surface area of the second light emergent face and a surface area of the third light emergent face.

15. The LED unit of claim 12, wherein the third emergent face has a curved top edge connected to the first light emergent face, and a straight bottom edge connected to the second light emergent face.

16. The LED unit of claim 12, wherein the second member has a height less than a height of the first member.

17. The LED unit of claim 12, wherein the light incident face is has a concave surface viewed from the LED.

18. A lens comprising:

a light incident face for transmitting light into the lens; and a light emitting face for transmitting light out of the lens; wherein the light emitting face comprises a first light emergent face, a second light emergent face, and a third light emergent face connecting to the first emergent face on a first edge and to the second light emergent face on a second edge; the first light emergent face has a convex surface; the second light emergent face has a flat surface finish; and the third light emergent face has a rough surface finish.

19. The lens of claim 18, wherein the second light emergent face is at an angle from the third light emergent faces, measured facing inside the lens, and the angle is between 180 degrees and 270 degrees.

20. The lens of claim 19, wherein the second light emergent face is inclined relative to an optical axis of the first light emergent face.

* * * * *